US011728574B2

(12) United States Patent
Furman et al.

(10) Patent No.: US 11,728,574 B2
(45) Date of Patent: Aug. 15, 2023

(54) MODULAR BASE FOR AN ANTENNA ARRAY

(71) Applicant: Honeywell Federal Manufacturing & Technologies, LLC, Kansas City, MO (US)

(72) Inventors: Nicholas J. Furman, Overland Park, KS (US); Kyle Byers, Leawood, KS (US); Daniel Salzman, Lee's Summit, MO (US)

(73) Assignee: HONEYWELL FEDERAL MANUFACTURING & TECHNOLOGIES, LLC, Kansas City, MO (US)

( * ) Notice: Subject to any disclaimer, the term of this patent is extended or adjusted under 35 U.S.C. 154(b) by 1 day.

(21) Appl. No.: 17/399,363

(22) Filed: Aug. 11, 2021

(65) Prior Publication Data

US 2023/0046006 A1 Feb. 16, 2023

(51) Int. Cl.

| | |
|---|---|
| ***H01Q 21/00*** | (2006.01) |
| ***H01Q 1/08*** | (2006.01) |
| ***H01Q 21/06*** | (2006.01) |

(52) U.S. Cl.
CPC ..... *H01Q 21/0025* (2013.01); *H01Q 1/084* (2013.01); *H01Q 21/065* (2013.01)

(58) Field of Classification Search
CPC ... H01Q 21/0025; H01Q 21/065; H01Q 1/084
See application file for complete search history.

(56) References Cited

U.S. PATENT DOCUMENTS

| | | | | |
|---|---|---|---|---|
| 9,013,361 | B1 * | 4/2015 | Lam | H01Q 21/061 343/893 |
| 2017/0043550 | A1 * | 2/2017 | Coïc | B32B 3/12 |
| 2017/0256866 | A1 * | 9/2017 | Schadeck | H01Q 1/1207 |
| 2023/0046006 | A1 * | 2/2023 | Furman | H01Q 1/38 |

* cited by examiner

*Primary Examiner* — Jason Crawford
(74) *Attorney, Agent, or Firm* — Hovey Williams LLP

(57) ABSTRACT

A base configured to be joined with other bases to form a substrate for an antenna array comprises a body, a plurality of male interconnecting features, and a plurality of female interconnecting features. The body includes a front surface and a rear surface and a plurality of edges positioned therebetween. The front surface or the rear surface is configured to retain an antenna. The male interconnecting features of a first base connect with the female interconnecting features of a second base when the first base is joined with the second base to form the substrate or a portion of the substrate.

15 Claims, 9 Drawing Sheets

MODULAR BASE FOR AN ANTENNA ARRAY

STATEMENT REGARDING FEDERALLY-SPONSORED RESEARCH OR DEVELOPMENT

This invention was made with Government support under Contract No.: DE-NA0002839 awarded by the United States Department of EnergylNational Nuclear Security Administration. The Government has certain rights in the invention.

FIELD OF THE INVENTION

Embodiments of the current invention relate to structures on which antenna arrays are positioned.

DESCRIPTION OF THE RELATED ART

Antenna arrays include a plurality of antenna elements that are arranged in a one-dimensional linear array or a two-dimensional square or rectangular array. Each antenna element converts an electronic signal into a corresponding wireless signal (i.e., radio frequency electromagnetic radiation) and vice-versa. An example of the array is a phased antenna array in which a phase of the electronic signal for each antenna element is adjusted to control the direction in which the wireless signal is transmitted or received. Typically the entire array is mounted on a single structure such as a printed circuit board or other non-conducting substrate. One drawback to this approach is that it makes prototyping and development difficult because antenna elements cannot be easily added or removed in order to change the configuration of the array.

SUMMARY OF THE INVENTION

Embodiments of the current invention address one or more of the above-mentioned problems and provide a base on which an antenna is positioned to form an antenna element. Multiple bases may be joined together to form a one-dimensional or a two-dimensional antenna array. Each pair of bases is held together with a pin. Thus, bases may easily be added or removed to change the configuration of the array.

The base broadly comprises a body, a plurality of male interconnecting features, and a plurality of female interconnecting features. The body includes a front surface and a rear surface and a plurality of edges positioned therebetween. The front surface or the rear surface is configured to retain the antenna. The male interconnecting features of a first base connect with the female interconnecting features of a second base when the first base is joined with the second base to form the antenna array or a portion of the antenna array.

Another embodiment of the current invention provides an antenna element configured to be joined with other antenna elements to form an antenna array. The antenna element broadly comprises an antenna and a base. The antenna is configured to convert an electronic signal into a corresponding wireless radio frequency signal and convert a wireless radio frequency signal into a corresponding electronic signal. The includes a body, a plurality of male interconnecting features, and a plurality of female interconnecting features. The body includes a front surface and a rear surface and a plurality of edges positioned therebetween. The front surface or the rear surface is configured to retain the antenna. The male interconnecting features of a first base connect with the female interconnecting features of a second base when the first base is joined with the second base to form the antenna array or a portion of the antenna array.

Yet another embodiment of the current invention provides an antenna array broadly comprising a plurality of antenna elements joined together, with each antenna element including an antenna and a base. The antenna is configured to convert an electronic signal into a corresponding wireless radio frequency signal and convert a wireless radio frequency signal into a corresponding electronic signal. The includes a body, a plurality of male interconnecting features, and a plurality of female interconnecting features. The body includes a front surface and a rear surface and a plurality of edges positioned therebetween. The front surface or the rear surface is configured to retain the antenna. The male interconnecting features of a first base connect with the female interconnecting features of a second base when the first base is joined with the second base to form the antenna array or a portion of the antenna array.

This summary is provided to introduce a selection of concepts in a simplified form that are further described below in the detailed description. This summary is not intended to identify key features or essential features of the claimed subject matter, nor is it intended to be used to limit the scope of the claimed subject matter. Other aspects and advantages of the current invention will be apparent from the following detailed description of the embodiments and the accompanying drawing figures.

BRIEF DESCRIPTION OF THE DRAWING FIGURES

Embodiments of the current invention are described in detail below with reference to the attached drawing figures, wherein.

Figure 6:
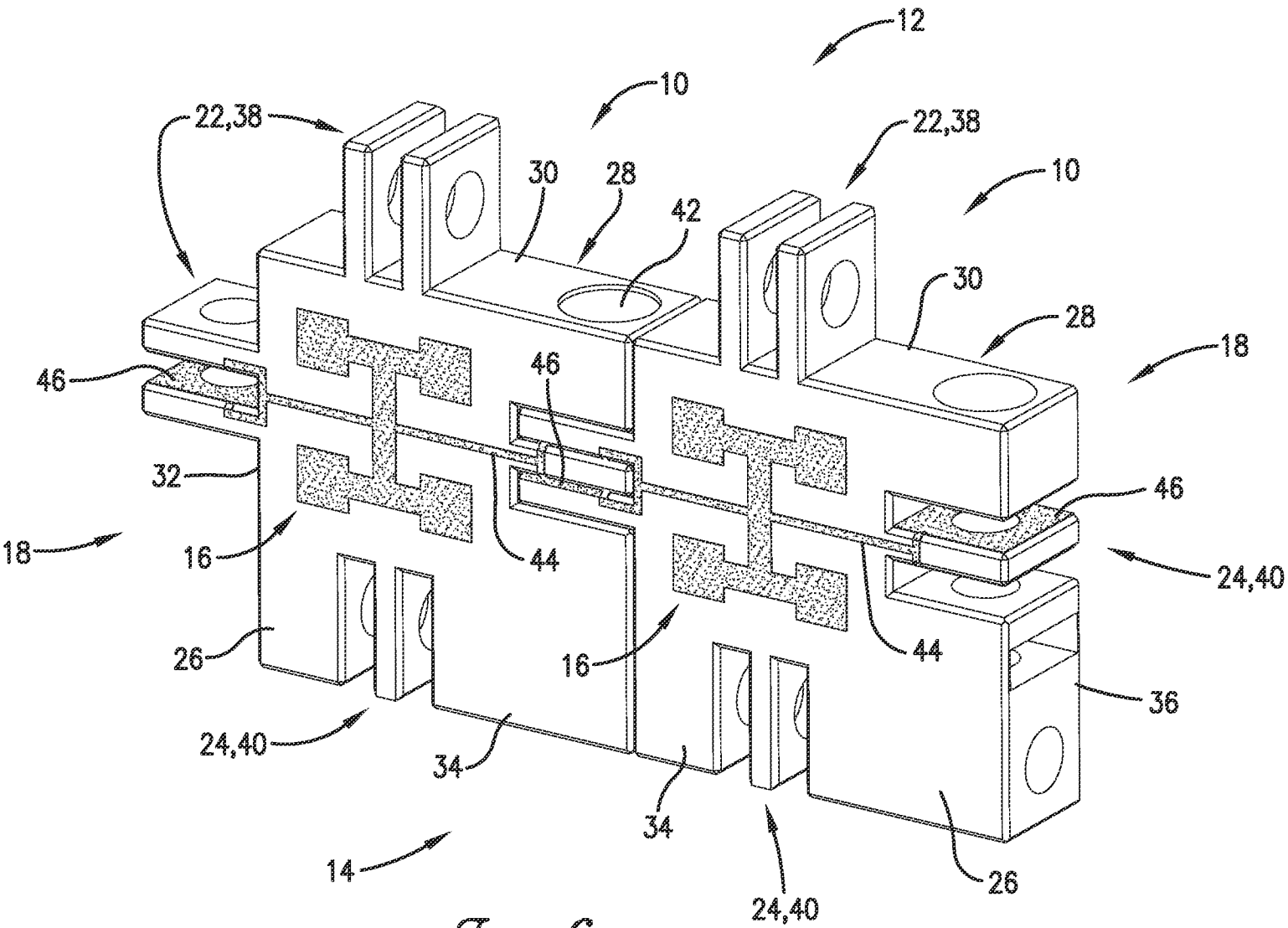
Figure 8:
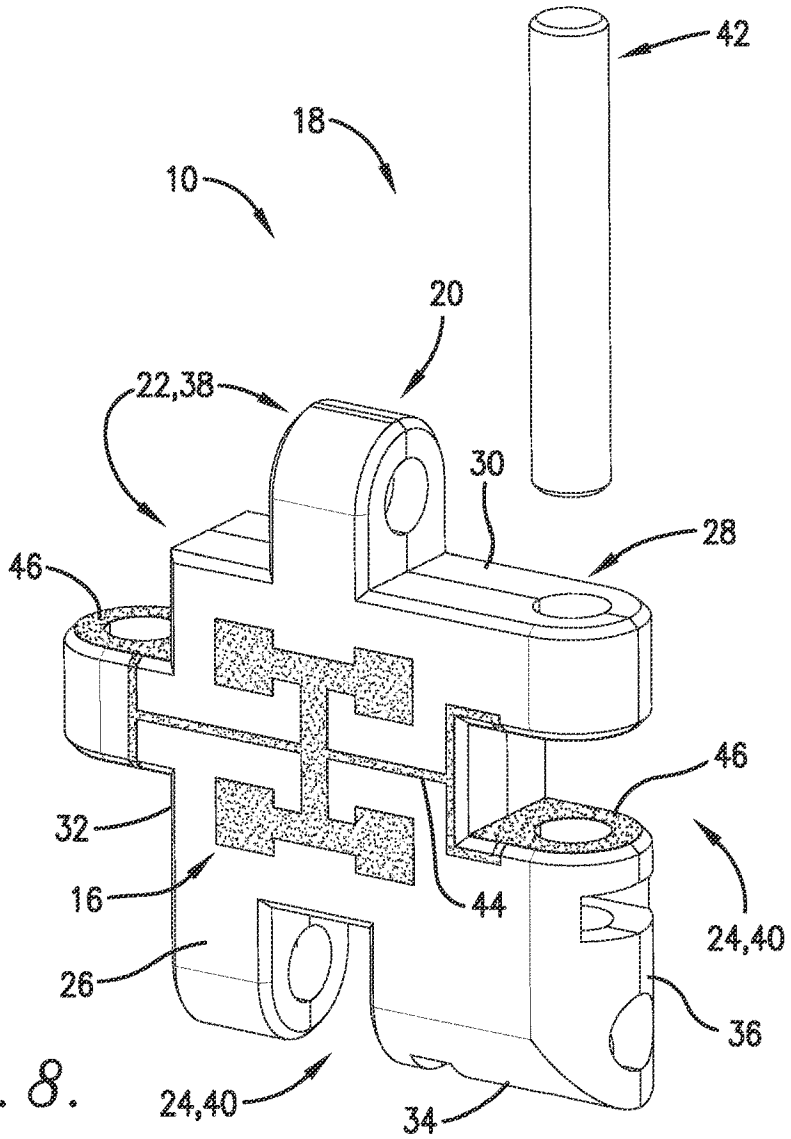
Figure 7:
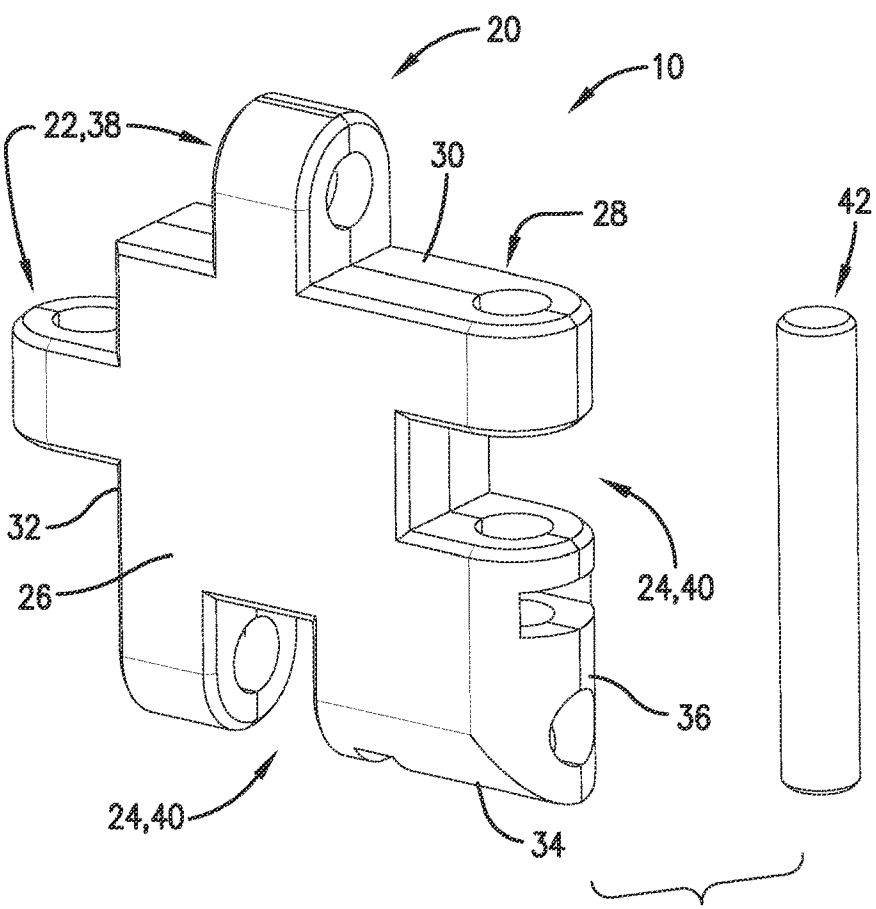
Figure 9:
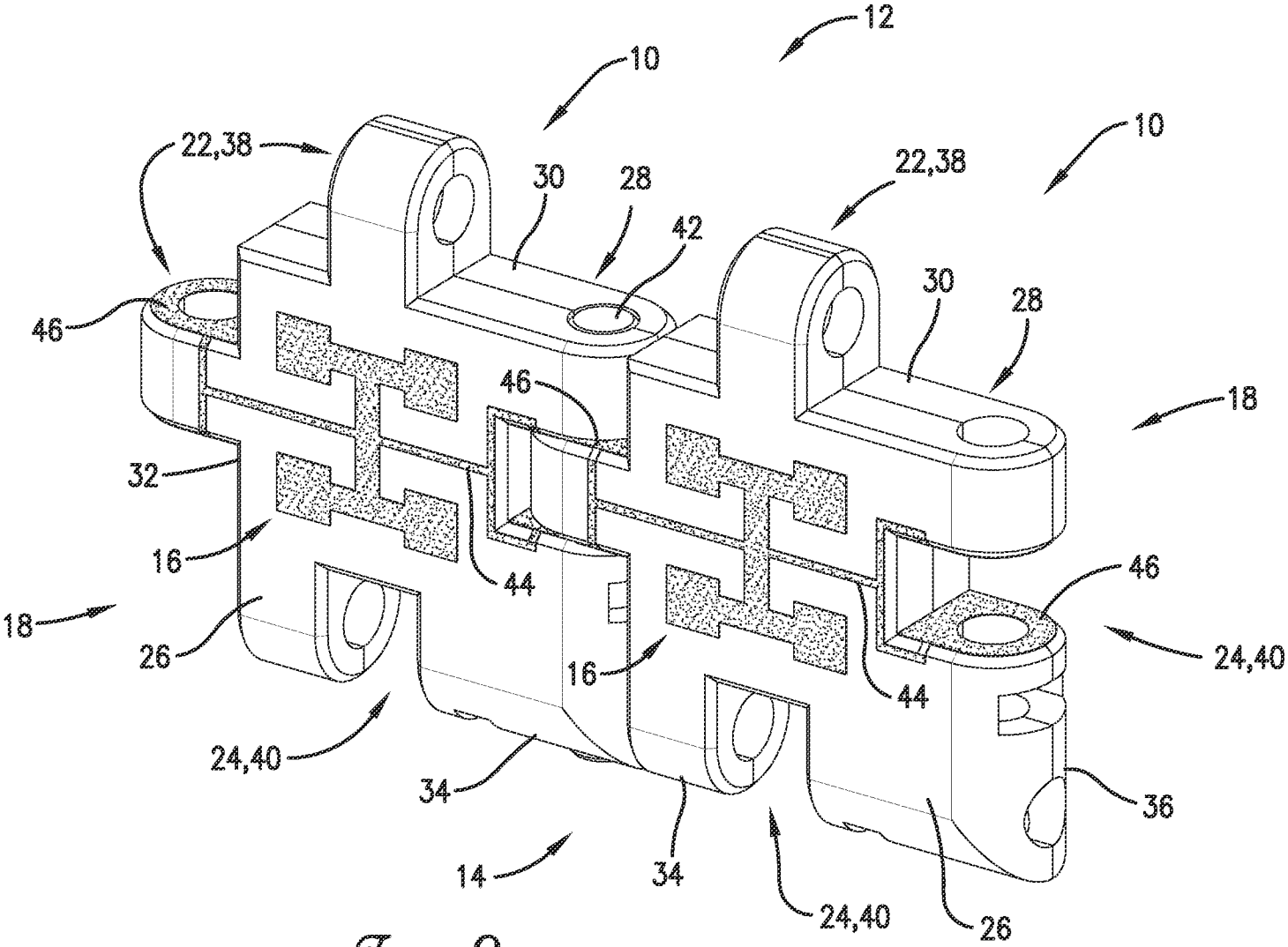
Figure 10:
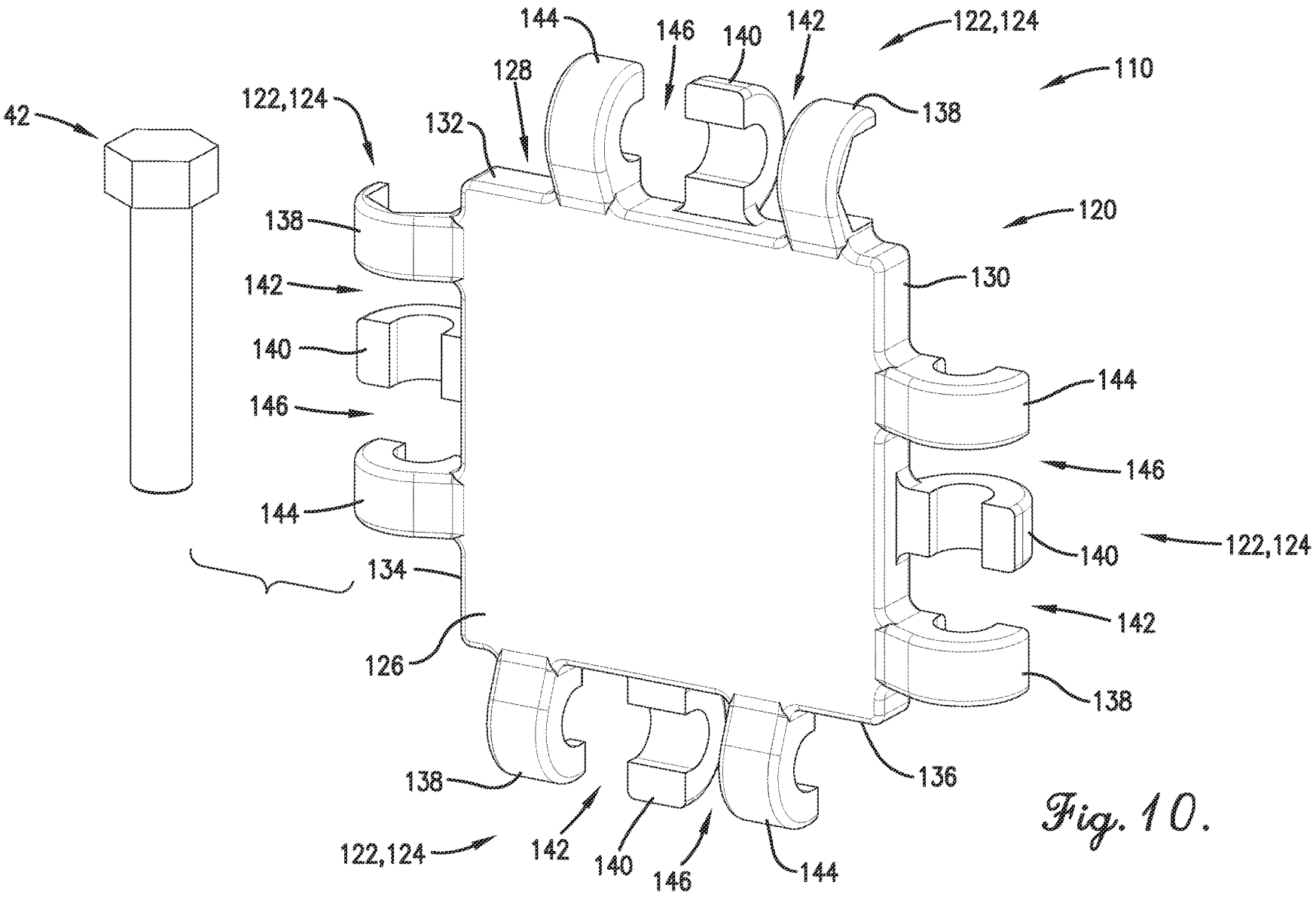
Figure 11:
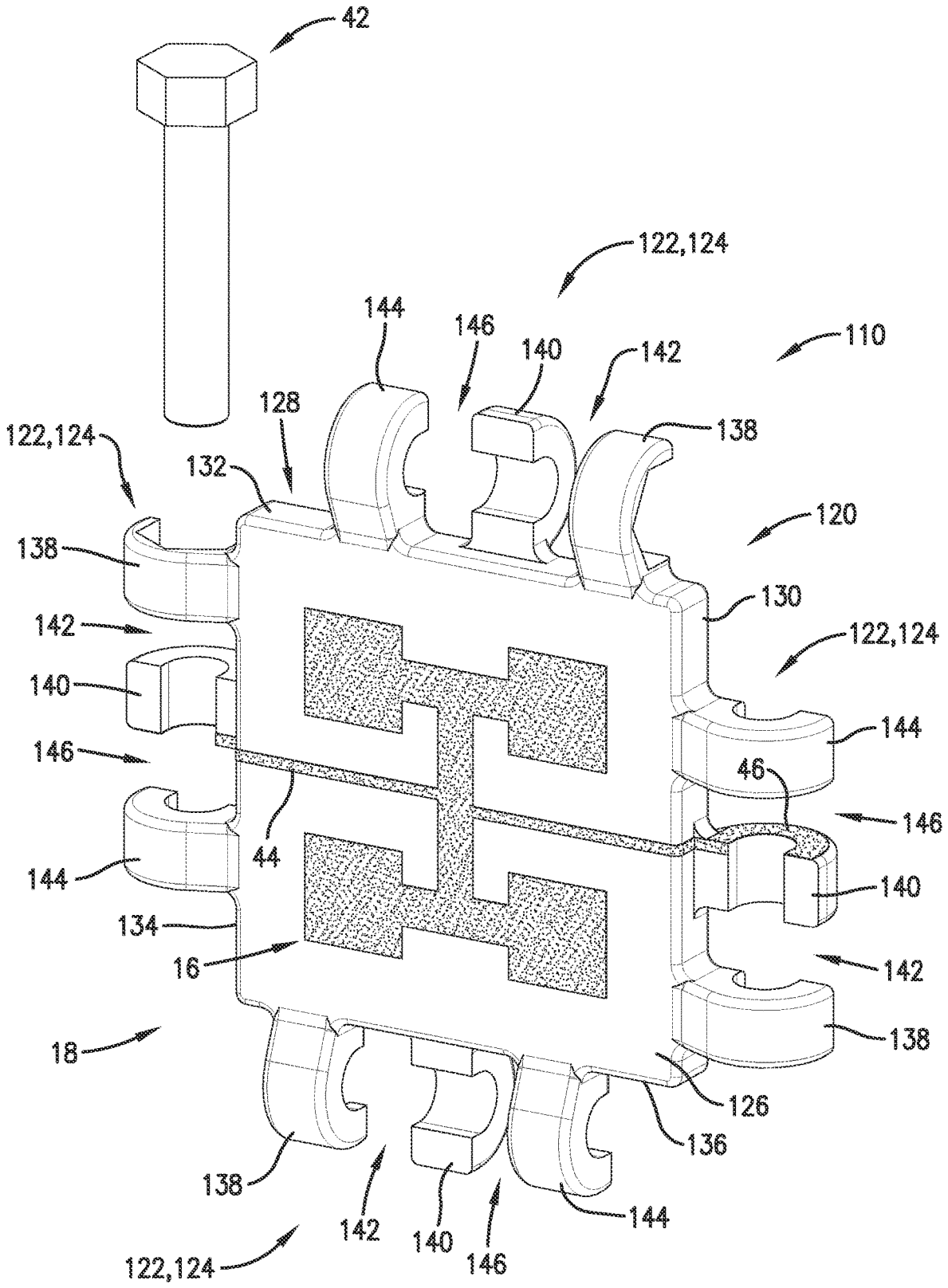
Figure 12:
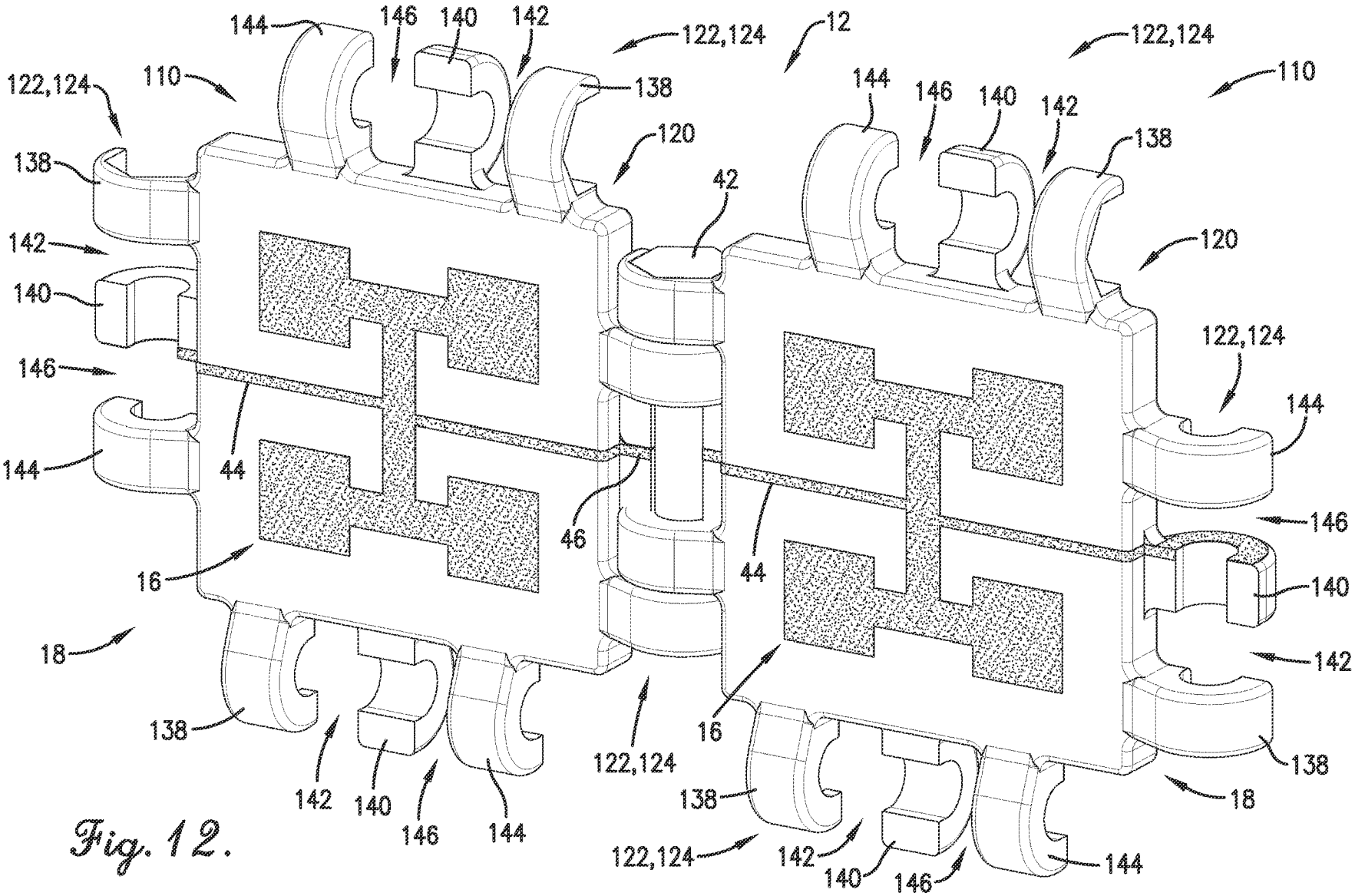

FIG. 6 a front perspective view of the second embodiment of two antenna elements joined together to form a second embodiment of the antenna array;

FIG. 7 is a front perspective view of a third embodiment of the base and the pin;

FIG. 8 is a front perspective view of a third embodiment of the antenna element and the pin;

FIG. 9 a front perspective view of the third embodiment of two antenna elements joined together to form a third embodiment of the antenna array;

FIG. 10 is a front perspective view of a fourth embodiment of the base and the pin;

FIG. 11 is a front perspective view of a fourth embodiment of the antenna element and the pin; and FIG. 12 a front perspective view of the fourth embodiment of two antenna elements joined together to form a fourth embodiment of the antenna array The drawing figures do not limit the current invention to the specific embodiments disclosed and described herein. The drawings are not necessarily to scale, emphasis instead being placed upon clearly illustrating the principles of the invention.

DETAILED DESCRIPTION OF THE EMBODIMENTS

The following detailed description of the technology references the accompanying drawings that illustrate specific embodiments in which the technology can be practiced. The embodiments are intended to describe aspects of the technology in sufficient detail to enable those skilled in the art to practice the technology. Other embodiments can be utilized and changes can be made without departing from the scope of the current invention. The following detailed description is, therefore, not to be taken in a limiting sense. The scope of the current invention is defined only by the appended claims, along with the full scope of equivalents to which such claims are entitled.

Figure 2:
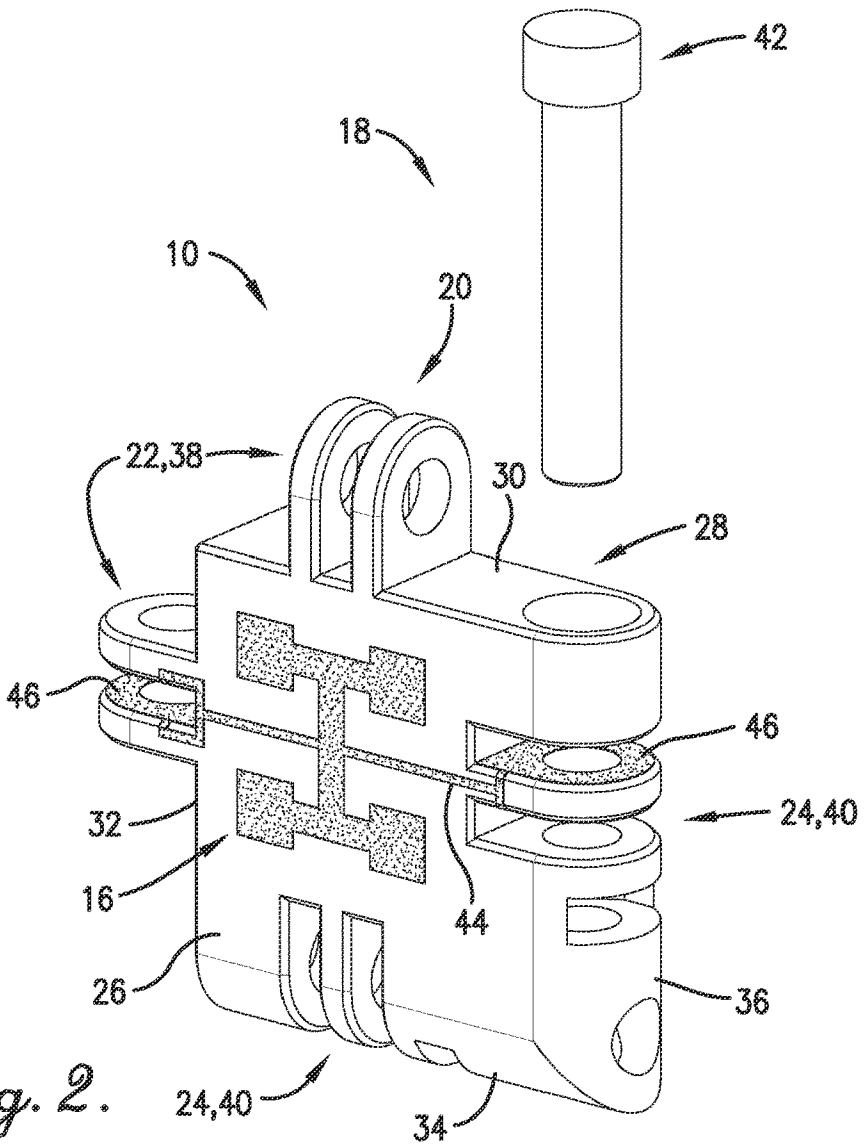
FIG. 2 is a front perspective view of the base and the pin, the base retaining an antenna on its front surface, the base and the antenna in combination forming an antenna element.
Figure 1:
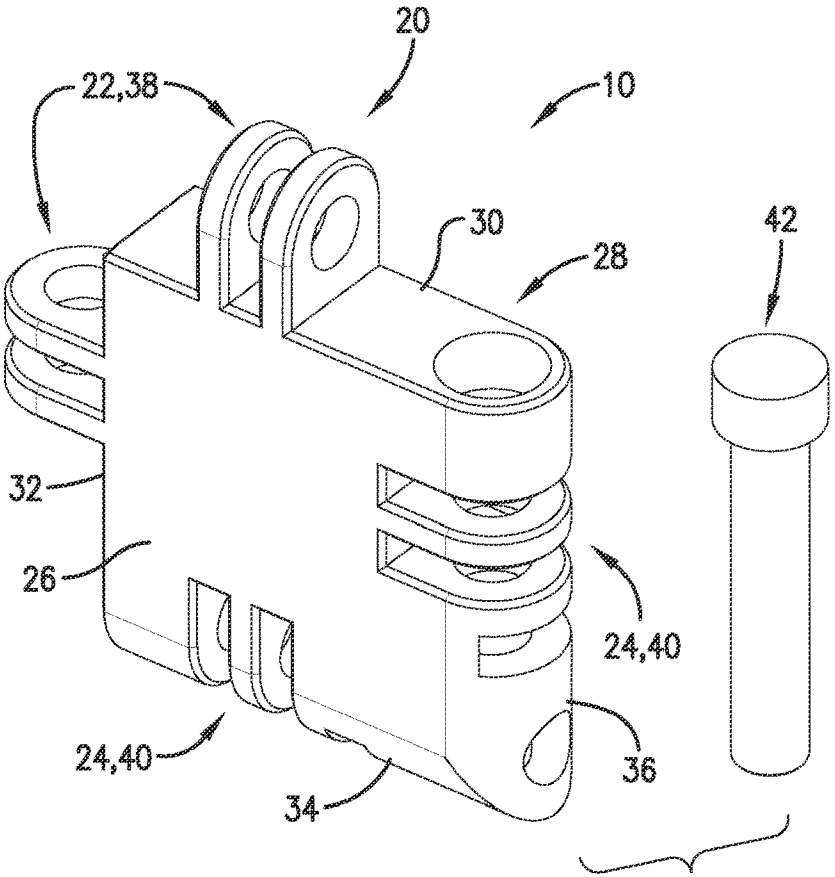
FIG. 1 is a front perspective view of a base, constructed in accordance with at least one embodiment of the current invention, to be joined with other bases to form a substrate for an antenna array, the base accompanied by a pin used to join two bases together.
Figure 3:
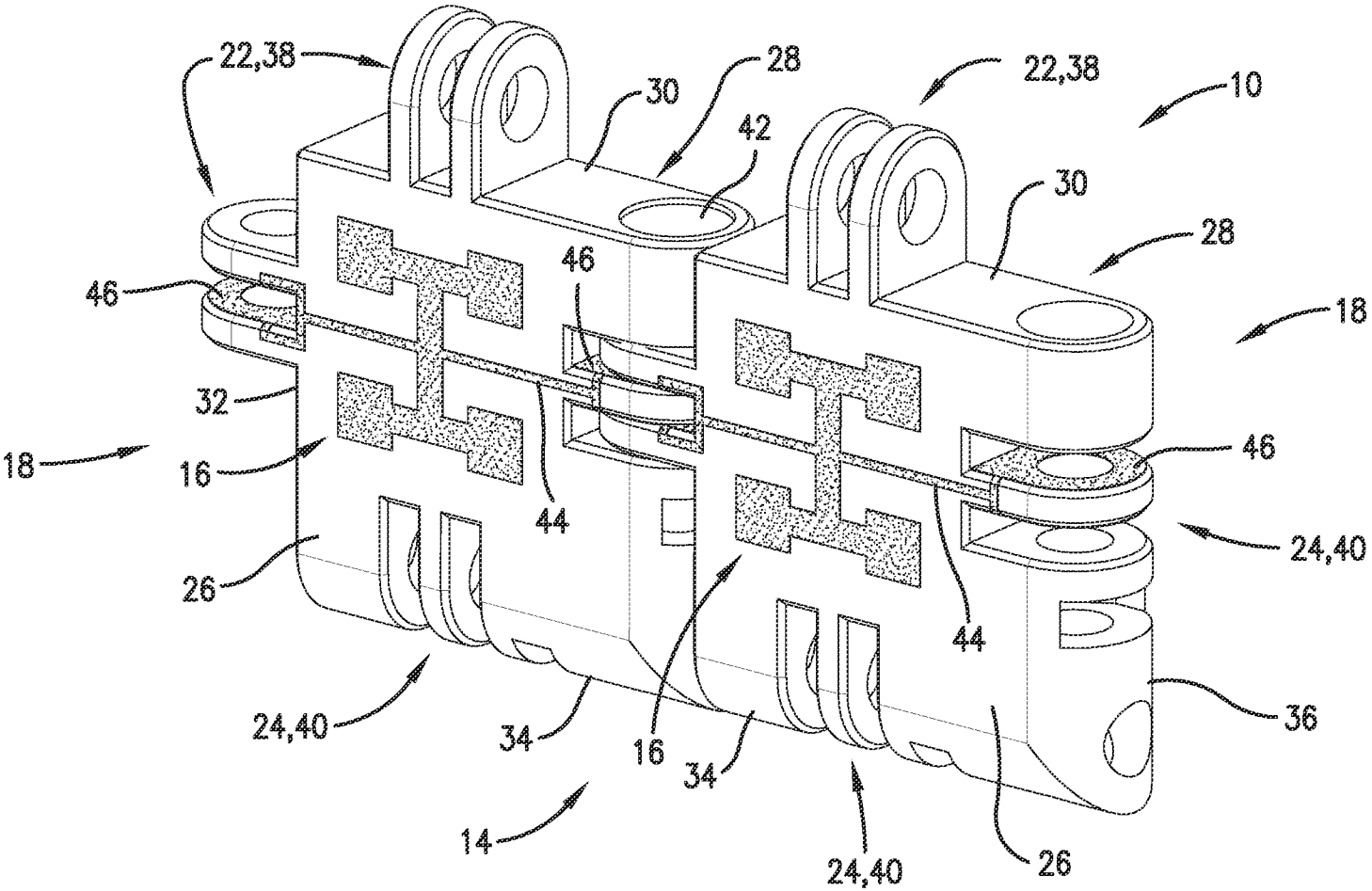
FIG. 3 is a front perspective view of two antenna elements joined together to form the antenna array.

Referring to FIGS. 1-3, a base 10, constructed in accordance with various embodiments of the current invention, for forming an antenna array 12 is shown. The antenna array 12 includes a plurality of bases 10 interconnected with one another to form a substrate 14 for the antenna array 12. Each base 10 has an antenna 16 positioned on at least one of its surfaces which forms an antenna element 18. The antenna elements 18 operate in combination to create antenna configurations such as a phased antenna array.

The base 10 broadly comprises a body 20, a plurality of male interconnecting features 22, and a plurality of female interconnecting features 24. The body 20 includes a front surface 26, an opposing rear surface 28, and four edges positioned therebetween, with the edges including a first male edge 30, a second male edge 32, a first female edge 34, and a second female edge 36. Although four edges 30, 32, 34, 36 are described and shown in the figures, implying a quadrilateral shaped body 20, the body 20 may have three or more edges which form nearly any geometric shape. The first male edge 30 and the second male edge 32 are positioned adjacent to one another. The first female edge 34 and the second female edge 36 are positioned adjacent to one another. The first male edge 30 opposes the first female edge 34, and the second male edge 32 opposes the second female edge 36. Each male edge 30, 32 has a generally planar surface to which the male interconnecting features 22 are attached. Each female edge 34, 36 has a generally rounded surface in which the female interconnecting features 24 are formed.

The male interconnecting features 22 removably connect, couple, or mate with the female interconnecting features 24. Generally, the male interconnecting features 22 are selected to be complementary to the female interconnecting features 24. In exemplary embodiments, the male interconnecting features 22 include a plurality of knuckles 38, that are spaced apart from one another along the male edge 30, 32, wherein each knuckle 38 including a tab that extends away from the male edge 30, 32. In addition, each knuckle 38 has a rounded outer surface and a through hole adjacent to the outer surface. The female interconnecting features 24 include a plurality of openings 40 that are spaced apart and formed in the female edge 34, 36. Each opening 40 receives a successive one of the knuckles 38 and has a width slightly greater than a width of one knuckle 38. Furthermore, each female edge 34, 36 includes a chamber that is cylindrically shaped and positioned along the length of the edge.

In some embodiments, the male interconnecting features 22 may automatically lock with, or be retained in, the female interconnecting features 24 without additional components. In exemplary embodiments, the base 10 includes, or is accompanied by, at least one pin 42 to lock the male interconnecting features 22 with the female interconnecting features 24, and in turn, lock a first base 10 with a second base 10. The pin 42 is positioned within the chamber of one female edge 34, 36 of the first base 10 after the knuckles 38 of the second base 10 have been placed in the openings 40 of the first base 10.

Figure 5:
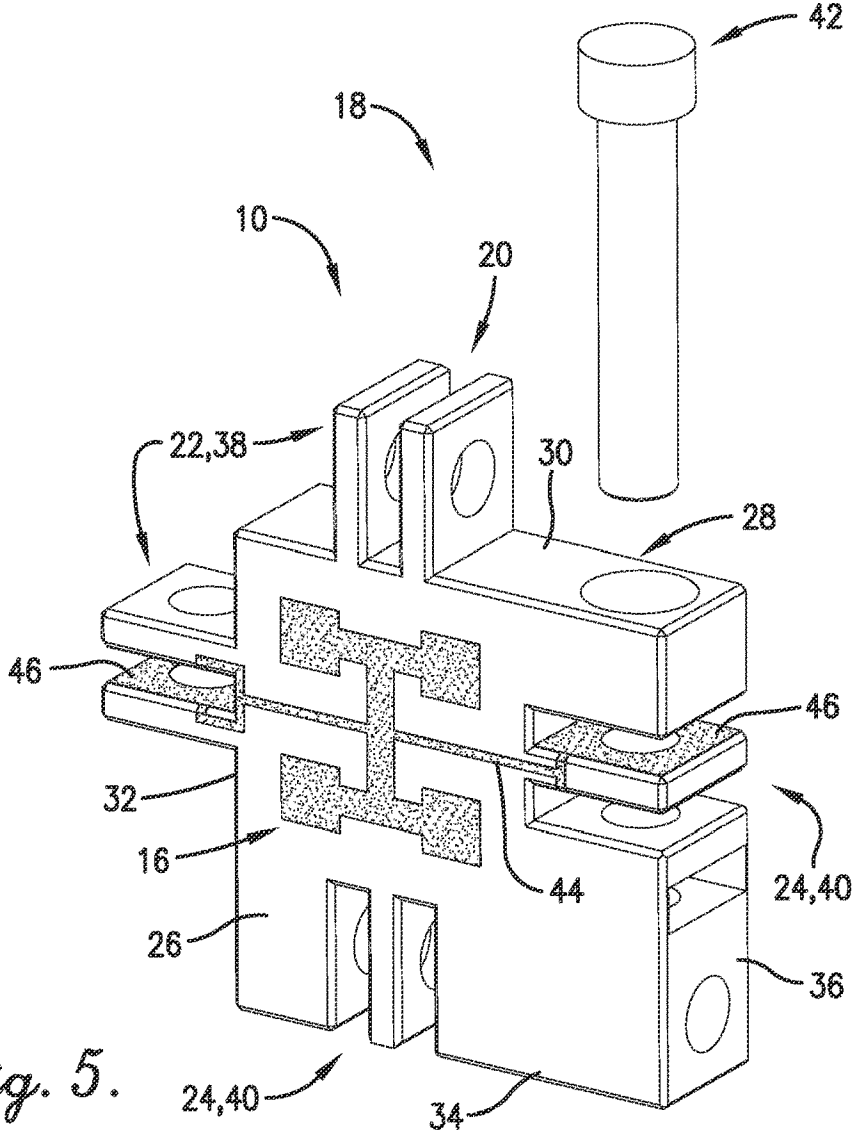
FIG. 5 is a front perspective view of a second embodiment of the antenna element and the pin.
Figure 4:
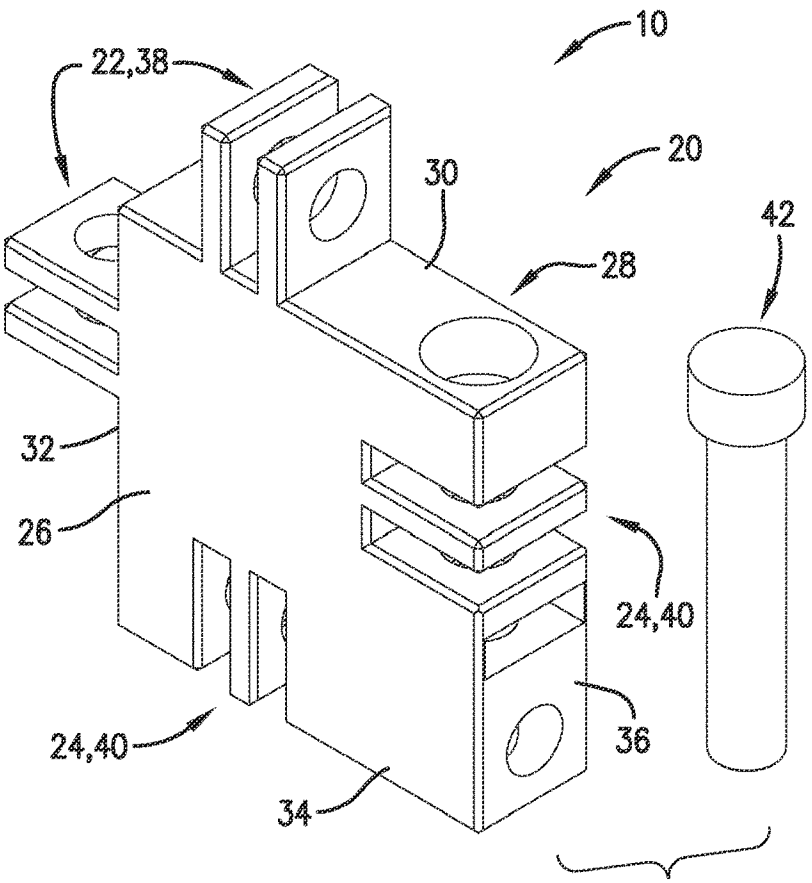
FIG. 4 is a front perspective view of a second embodiment of the base and the pin.

Referring to FIGS. 4-6, a second embodiment of the base 10 is shown. The second embodiment includes orthogonal, or squared-off, female edges 34, 36 and orthogonal, or squared-off, knuckles 38. Referring to FIGS. 7-9, a third embodiment of the base 10 is shown. The third embodiment includes a single knuckle 38 on each male edge 30, 32 and a single opening 40 on each female edge 34, 36.

Referring to FIGS. 10-12, a fourth embodiment of the base 110 is shown. The base 110 broadly comprises a body 120, a plurality of male interconnecting features 122, and a plurality of female interconnecting features 124. The body 120 has a front surface 126, an opposing rear surface 128, and four edges positioned therebetween, with a first edge 130, a second edge 132, a third edge 134 opposing the first edge 130, and a fourth edge 136 opposing the second edge 132.

The male interconnecting features 122 include at least a first finger 138 and a second finger 140 positioned on each edge of the body 120. The first finger 138 has an arch, an arcuate shape, or a curvature with an apex along one surface that extends upward in a direction that is normal to, and away from, the front surface 126 of the body 120. The second finger 140 has an arch, an arcuate shape, or a curvature with an apex along one surface that extends downward in a direction that is normal to, and away from, the rear surface 128 of the body 120. The female interconnecting features 124 include at least a first space 142 positioned in between the first finger 138 and the second finger 140. Exemplary embodiments of the base 110 further include a third finger 144 and a second space 146 to provide additional stability when the bases 110 are joined to one another. The third finger 144 has an arch, an arcuate shape, or a curvature with an apex along one surface that extends upward in a direction that is normal to, and away from, the front surface 126 of the body 120. The second space 146 is positioned between the second finger 140 and the third finger 144. Each space 142, 146 has a width that is slightly greater than a width of one finger 138, 140, 144. Each of the fingers 138, 140, 144 includes a cylindrical shaped cavity opposite the apex of the arch.

The fingers 138, 140, 144 and the spaces 142, 146 are offset from one another on opposing edges 130, 132, 134, 136 of the body 120. For example, the first finger 138 on the first edge 130 is aligned with an end space on the third edge 134, the first space 142 on the first edge 130 is aligned with the third finger 144 on the third edge 134, and so forth. This configuration allows for the fingers 138, 140, 144 of a first base 110 to fit into the spaces 142, 146 of a second base 110 and for the fingers 138, 140, 144 of the second base 110 to fit into the spaces 142, 146 of the first base 110 when the bases 110 are joined together.

Like the base 10, the base 110 includes, or is accompanied by, at least one pin 42 to lock the interconnecting features 122, 124 of the first base 110 with the interlocking features 122, 124 of the second base 110. Specifically, when the fingers 138, 140, 144 of the first base 110 are positioned in the spaces 142, 146 of the second base 110 and the fingers 138, 140, 144 of the second base 110 are positioned in the spaces 142, 146 of the first base 110, a channel is created by the cavities of the fingers 138, 140, 144 being aligned with one another. The pin 42 is then placed in the channel which locks the two sets of fingers 138, 140, 144, and in turn, the two bases 110, together.

Each base 10, 110 is formed from electrically insulating, or dielectric, materials such as polymers, fiberglass, or the like. Exemplary materials include polycarbonate acrylonitrile butadiene styrene (PC/ABS) alloy, ABS, or other thermoplastics that can be molded. Alternatively, or additionally, each base 10 may be formed from materials, such as polymers, which can be utilized in additive manufacturing, such as 3D printing, techniques. Thus, each base 10, 110 may be formed using molding or additive manufacturing processes.

Each antenna 16 generally converts an electronic signal into a corresponding wireless signal (i.e., radio frequency electromagnetic radiation) and vice-versa and is formed from electrically conductive material such as metals or metal alloys. The shape and dimensions of the antenna 16 may vary according to a wavelength, or a fraction thereof, such as a half wavelength or a quarter wavelength. Examples of the antenna 16 are shown in FIGS. 2, 3, 5, 6, 8, 9, 11, and 12. Each antenna 16 further includes, or is accompanied by, one or more electrically conductive traces 44 that provide the antenna 16 with an electronic signal connection and/or an electrical ground connection. The antenna 16 is generally centrally positioned on either the front surface 26, 126 or the rear surface 28, 128 of the base 10, 110. Each trace 44 electrically connects to the antenna 16 and terminates at a terminal 46 at one of the male interconnect features 22, 122 or the female interconnect features 24, 124. In the examples shown in FIGS. 2, 3, 5, 6, 8, and 9, each base 10 includes a first trace 44 that electrically connects to the antenna 16 and terminates at the terminal 46 at a first male interconnect feature 22. Each base 10 includes a second trace 44 that electrically connects to the antenna 16 and terminates at the terminal 46 at a first female interconnect feature 24. In the examples shown in FIGS. 11 and 12, each base 110 includes a first trace 44 that electrically connects to the antenna 16 and terminates at the terminal 46 at one male interconnect feature 122 along one edge. Each base 10 includes a second trace 44 that electrically connects to the antenna 16 and terminates at the terminal 46 at one male interconnect feature 122 along an opposing edge. This allows for an electrical connection to be made from a first antenna 16 on a first base 10, 110 to a second antenna element 18 on a second base 10, 110.

Although one antenna 16 and its accompanying traces 44 are described and shown in the figures as being positioned on the front surface 26, 126 of the body 20, 120, in various embodiments, a first antenna 16 and its accompanying traces 44 may be positioned on the front surface 26, 126 and a second antenna 16 and its accompanying traces 44 may be positioned on the rear surface 28, 128.

The antenna element 18 may be formed by depositing or forming the antenna 16 and the traces 44 on the base 10, 110 through the use of laser direct structuring (if the material of the base 10, 110 includes a metal-organic complex) and electroless plating or physical vapor deposition or the like. Printing techniques may be utilized as well to deposit the antenna 16 and the traces 44 on the base 10, 110.

The antenna array 12 may be formed by constructing as many antenna elements 18 as are required by the array. That is, an M×N antenna array 12 requires (M×N) antenna elements 18. The bases 10, 110 of the antenna elements 18 are connected or coupled to one another to form the antenna array 12. For each pair of bases 10, 110 that are joined together, the male interconnecting features 22, 122 of one base 10, 110 connect or couple to the female interconnecting features 24, 124 of another base 10, 110. When utilizing the base 10, the knuckles 38 of the first base 10 are positioned in the openings 40 of the second base 10. When utilizing the base 110, the fingers 138, 140, 144 of the first base 110 are positioned in the spaces 142, 146 of the second base 110, and the fingers 138, 140, 144 of the second base 110 are positioned in the spaces 142, 146 of the first base 110.

When the male interconnecting features 22, 122 of one base 10, 110 are connected or coupled to the female interconnecting features 24, 124 of another base 10, 110, the two bases 10, 110 are locked together. When utilizing the base 10, one pin 42 is positioned in the chamber of the second base 10. When utilizing the base 110, one pin 42 is positioned in the channel formed by the connecting or coupling of the fingers 138, 140, 144 of the two bases 110.

One or more traces 44 on each antenna element 18 electrically connect to the antenna 16 and terminate at terminals 46 at one of the male interconnect features 22, 122 and/or the female interconnect features 24, 124. The traces 44 on one antenna element 18 may electrically connect to traces 44 on other antenna elements 18 through the terminals 46. Or, the traces 44 on one antenna element 18 may electrically connect to signal or electric ground feed lines from external sources, wherein the external sources electrically connect to the terminals 46.

Furthermore, the pin 42 provides an axis of rotation for any two connected bases 10, 110 such that one base 10, 110 may be rotated either clockwise or counter clockwise about the pin 42 in relation to the other base 10, 110.

An example of an antenna array 12 is a phased antenna array which is capable of transmitting and receiving an aggregate wireless signal in a plurality of directions in space while the antenna elements 18 are held stationary and not rotated. The antenna array 12 is configured with the appropriate traces 44 on the base 10 of each antenna element 18 so that each antenna element 18 can communicate an electronic signal. When the antenna array 12 is transmitting a wireless signal, the phase or delay time of each electronic signal is adjusted to set the direction in which the wireless signal will be transmitted. When the antenna array 12 is receiving a wireless signal, the corresponding electronic signals are delayed relative to one another according to the direction angle at which the wireless signal strikes the antenna array 12.

The base 10, 110 and the antenna arrays 12 that can be created using the base 10, 110 provide the following benefits and advantages compared to traditional antenna arrays: simpler fabrication at a lower cost at least as a result of being to plate metal for the antenna 16 onto the base 10, 110 in a smaller plating tank; easier replacement and repair because only defective elements need to be replaced; easier to scale up or down, as antenna elements 18 can easily be added to the antenna array 12 or removed from the antenna array 12; scalability in two dimensions; a greater variety of antenna array architectures, as antennas 16 can be placed on multiple surfaces and can have curved or conformal shapes; and antenna arrays 12 can be custom tuned.

ADDITIONAL CONSIDERATIONS

Throughout this specification, references to "one embodiment", "an embodiment", or "embodiments" mean that the feature or features being referred to are included in at least one embodiment of the technology. Separate references to "one embodiment", "an embodiment", or "embodiments" in this description do not necessarily refer to the same embodiment and are also not mutually exclusive unless so stated and/or except as will be readily apparent to those skilled in the art from the description. For example, a feature, structure, act, etc. described in one embodiment may also be included in other embodiments, but is not necessarily included. Thus, the current invention can include a variety of combinations and/or integrations of the embodiments described herein.

Although the present application sets forth a detailed description of numerous different embodiments, it should be understood that the legal scope of the description is defined by the words of the claims set forth at the end of this patent and equivalents. The detailed description is to be construed as exemplary only and does not describe every possible embodiment since describing every possible embodiment would be impractical. Numerous alternative embodiments may be implemented, using either current technology or technology developed after the filing date of this patent, which would still fall within the scope of the claims.

Throughout this specification, plural instances may implement components, operations, or structures described as a single instance. Although individual operations of one or more methods are illustrated and described as separate operations, one or more of the individual operations may be performed concurrently, and nothing requires that the operations be performed in the order illustrated. Structures and functionality presented as separate components in example configurations may be implemented as a combined structure or component. Similarly, structures and functionality presented as a single component may be implemented as separate components. These and other variations, modifications, additions, and improvements fall within the scope of the subject matter herein.

As used herein, the terms "comprises," "comprising," "includes," "including," "has," "having" or any other variation thereof, are intended to cover a non-exclusive inclusion. For example, a process, method, article, or apparatus that comprises a list of elements is not necessarily limited to only those elements but may include other elements not expressly listed or inherent to such process, method, article, or apparatus.

The patent claims at the end of this patent application are not intended to be construed under 35 U.S.C. § 112(f) unless traditional means-plus-function language is expressly recited, such as "means for" or "step for" language being explicitly recited in the claim(s).

Although the technology has been described with reference to the embodiments illustrated in the attached drawing figures, it is noted that equivalents may be employed and substitutions made herein without departing from the scope of the technology as recited in the claims.

Having thus described various embodiments of the technology, what is claimed as new and desired to be protected by Letters Patent includes the following:

1. A base configured to be joined with other bases to form a substrate for an antenna array, the base comprising:

a body including a front surface and a rear surface and a plurality of edges positioned therebetween, the front surface or the rear surface configured to retain an antenna; and a plurality of male interconnecting features and a plurality of female interconnecting features, wherein the male interconnecting features of a first base connect with the female interconnecting features of a second base when the first base is joined with the second base to form the substrate or a portion of the substrate, the male interconnect features including a plurality of spaced apart knuckles positioned along opposing edges of the body, the female interconnect features including a plurality of spaced apart openings formed in opposing edges of the body, a successive one of a portion of the knuckles positioned within a successive one of a portion of the openings when the first base is joined with the second base, and each edge of the body in which openings are formed including a chamber that is cylindrically shaped and positioned along the length of the edge.

2. The base of claim 1, wherein each knuckle includes a tab extending away from the edge of the body, the tab having a rounded outer surface and a through hole adjacent to the outer surface and each opening has a width that is slightly greater than a width of one knuckle.

3. The base of claim 1, wherein a pin is positioned within the chamber of one of the bases to lock the bases together when the first base is joined with the second base.

4. An antenna element configured to be joined with other antenna elements to form an antenna array, comprising:

an antenna configured to convert an electronic signal into a corresponding wireless radio frequency signal and convert a wireless radio frequency signal into a corresponding electronic signal;

a base including a body including a front surface and a rear surface and a plurality of edges positioned therebetween, the antenna being positioned on either the front surface or the rear surface; and a plurality of male interconnecting features and a plurality of female interconnecting features, wherein the male interconnecting features of a first base connect with the female interconnecting features of a second base when a first antenna element is joined with a second antenna element to form the antenna array or a portion of the antenna array; and at least one conductive trace electrically connected to the antenna and terminating at one of the male interconnect features or one of the female interconnect features.

5. The antenna element of claim 4, wherein the male interconnect features include a plurality of spaced apart knuckles positioned along opposing edges of the body and the female interconnect features include a plurality of spaced apart openings formed in opposing edges of the body, and a successive one of a portion of the knuckles is positioned within a successive one of a portion of the openings when the first antenna element is joined with the second antenna element.

6. The antenna element of claim 5, wherein each edge of the body in which openings are formed includes a chamber that is cylindrically shaped and positioned along the length of the edge, and a pin is positioned within the chamber of one of the bases to lock the bases together when the first antenna element is joined with the second antenna element.

7. The antenna element of claim 4, wherein the male interconnect features include a plurality of spaced apart fingers positioned along each edge of the body and the female interconnect features include a plurality of spaces, each space being positioned between two adjacent fingers, and a successive one of a portion of the fingers is positioned within a successive one of a portion of the spaces when the first antenna element is joined with the second antenna element.

8. The antenna element of claim 7, wherein each finger has an arch shape with an apex along one surface of the finger and a cavity along an opposing surface of the finger, and each space has a width that is slightly greater than a width of one finger.

9. The antenna element of claim 8, wherein a channel is formed by the cavities of a portion of the fingers of the first base and a portion of the fingers of the second base being aligned with one another when the first antenna element is joined with the second antenna element, and a pin is positioned within the channel to lock the bases together.

10. An antenna array comprising:

a plurality of antenna elements joined together, each antenna element including an antenna configured to convert an electronic signal into a corresponding wireless radio frequency signal and convert a wireless radio frequency signal into a corresponding electronic signal; and a base including a body including a front surface and a rear surface and a plurality of edges positioned therebetween, the antenna being positioned on either the front surface or the rear surface; and a plurality of male interconnecting features and a plurality of female interconnecting features, wherein the male interconnecting features of a first base connect with the female interconnecting features of a second base of any pair of antenna elements joined together to form the antenna array or a portion of the antenna array, wherein each antenna element includes at least one conductive trace electrically connected to the antenna and terminating at one of the male interconnect features or one of the female interconnect features.

11. The antenna array of claim 10, wherein the male interconnect features of each base include a plurality of spaced apart knuckles positioned along opposing edges of the body and the female interconnect features include a plurality of spaced apart openings formed in opposing edges of the body, and a successive one of a portion of the knuckles is positioned within a successive one of a portion of the openings when any pair of antenna elements are joined together to form the antenna array or a portion of the antenna array.

12. The antenna array of claim 10, wherein the male interconnect features of each base include a plurality of spaced apart fingers positioned along each edge of the body and the female interconnect features include a plurality of spaces, each space being positioned between two adjacent fingers, and a successive one of a portion of the fingers is positioned within a successive one of a portion of the spaces when any pair of antenna elements are joined together to form the antenna array or a portion of the antenna array.

13. A base configured to be joined with other bases to form a substrate for an antenna array, the base comprising:

a body including a front surface and a rear surface and a plurality of edges positioned therebetween, the front surface or the rear surface configured to retain an antenna; and a plurality of male interconnecting features and a plurality of female interconnecting features, wherein the male interconnecting features of a first base connect with the female interconnecting features of a second base when the first base is joined with the second base to form the substrate or a portion of the substrate, the male interconnect features including a plurality of spaced apart fingers positioned along each edge of the body, the female interconnect features including a plurality of spaces, each space being positioned between two adjacent fingers, a successive one of a portion of the fingers being positioned within a successive one of a portion of the spaces when the first base is joined with the second base, each finger having an arch shape with an apex along one surface of the finger and a cavity along an opposing surface of the finger, each space having a width that is slightly greater than a width of one finger, and a channel is formed by the cavities of a portion of the fingers of the first base and a portion of the fingers of the second base being aligned with one another when the first base is joined with the second base.

14. The base of claim 13, wherein a pin is positioned within the channel to lock the bases together when the first base is joined with the second base.

15. An antenna element configured to be joined with other antenna elements to form an antenna array, comprising:

an antenna configured to convert an electronic signal into a corresponding wireless radio frequency signal and convert a wireless radio frequency signal into a corresponding electronic signal;

a base including a body including a front surface and a rear surface and a plurality of edges positioned therebetween, the antenna being positioned on either the front surface or the rear surface, and a plurality of male interconnecting features and a plurality of female interconnecting features, wherein the male interconnecting features of a first base connect with the female interconnecting features of a second base when a first antenna element is joined with a second antenna element to form the antenna array or a portion of the antenna array; and a conductive terminal formed on one of the male interconnecting features or one of the female interconnecting features, the conductive terminal configured to electrically connect to the conductive terminal on another antenna element.

* * * * *